US006692895B2

(12) United States Patent
Huang et al.

(10) Patent No.: US 6,692,895 B2
(45) Date of Patent: Feb. 17, 2004

(54) IMAGEABLE ARTICLE AND METHOD OF IMAGING

(75) Inventors: Haitao Huang, Austin, TX (US); Michael N. Miller, Austin, TX (US); Gary A. Shreve, Austin, TX (US); Robert D. Waid, Oakdale, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 272 days.

(21) Appl. No.: 09/864,638

(22) Filed: May 25, 2001

(65) Prior Publication Data

US 2002/0187426 A1 Dec. 12, 2002

(51) Int. Cl.[7] ..... G03C 1/76

(52) U.S. Cl. ..... 430/273.1; 430/292; 430/346; 430/944; 430/945

(58) Field of Search ..... 430/273.1, 292, 430/346, 944, 945

(56) References Cited

U.S. PATENT DOCUMENTS

| | | | | |
|---|---|---|---|---|
| RE24,906 | E | 12/1960 | Ulrich | |
| 3,928,670 | A * | 12/1975 | Brummett et al. | 430/414 |
| 4,388,400 | A * | 6/1983 | Tabei et al. | 430/346 |
| 4,499,178 | A * | 2/1985 | Wada et al. | 430/270.12 |
| 4,675,227 | A * | 6/1987 | Kivits et al. | 428/195 |
| 5,171,650 | A * | 12/1992 | Ellis et al. | 430/20 |
| 5,256,506 | A * | 10/1993 | Ellis et al. | 430/20 |
| 5,401,611 | A * | 3/1995 | Edwards et al. | 430/276.1 |
| 5,501,938 | A * | 3/1996 | Ellis et al. | 430/201 |
| 5,656,410 | A * | 8/1997 | Van Damme et al. | 430/256 |
| 5,766,827 | A | 6/1998 | Bills et al. | |
| 6,066,437 | A | 5/2000 | Kosslinger | |
| 6,068,966 | A * | 5/2000 | Koga | 430/322 |
| 6,180,318 | B1 | 1/2001 | Fitzer et al. | |
| 6,187,508 | B1 | 2/2001 | Andriessen et al. | |

FOREIGN PATENT DOCUMENTS

| | | | |
|---|---|---|---|
| EP | 384041 A1 * | 8/1990 | B32B/31/08 |
| EP | 0 866 750 | 8/1997 | |
| EP | 0 684 145 | 8/1998 | |
| EP | 0 980 764 | 2/2000 | |
| WO | WO 98/16397 | 4/1998 | |
| WO | WO 98/45827 | 10/1998 | |
| WO | WO 00/69648 | 11/2000 | |

OTHER PUBLICATIONS

Electroless Plating, Fundamentals and Applications, eds. G.O. Mallory and J.B. Hajdu, American Electroplaters and Surface Finishers Soc., 1990, pp. 207–259.

* cited by examiner

*Primary Examiner*—Janet Baxter
*Assistant Examiner*—Amanda C. Walke
(74) *Attorney, Agent, or Firm*—Scott A. Bardell

(57) ABSTRACT

A laser imageable article includes an imageable layer that comprises the reaction product of a metal precursor and a reactant. The imageable article also includes a first boundary layer on a first side of the imageable layer, the first boundary layer being substantially transparent to laser radiation, and a second boundary layer on a second side of the imageable layer. The imageable layer may be imaged with a laser through the first boundary layer while maintaining the continuity of the first boundary layer. In a preferred embodiment, the imageable layer comprises the reaction product of an ion of one or more metals selected from columns 8, 9, and 10 of the periodic table of elements and a reducing agent selected from hypophosphorus acid and salts thereof, sodium borohydride, and dimethylamine borane. One preferred embodiment of the imageable layer comprises from 1 to 30 mole percent phosphorus and up to 99 mole percent nickel. Another preferred embodiment of the imageable layer comprises from 1 to 40 mole percent boron and up to 99 mole percent nickel.

36 Claims, 1 Drawing Sheet

IMAGEABLE ARTICLE AND METHOD OF IMAGING

TECHNICAL FIELD

The present invention generally relates to imageable articles, and their methods of manufacture and imaging, and more particularly to imageable articles that include a laser-imageable layer that is the reaction product of a metal precursor and a reactant.

BACKGROUND OF THE INVENTION

Many techniques are commercially available for imparting images or information onto labels, tapes, and like articles. This includes various printing techniques such as flexography, lithography, and electrophotography.

It is also known to use a laser to impart images or information onto materials which can be imaged by laser. For example, U.S. Pat. No. 5,766,827 discloses a process for forming an image on a substrate comprising the steps of providing an imageable element comprising a film having a coating of a black metal on one surface thereof, directing radiation in an imagewise distributed pattern at said black metal layer with sufficient intensity to substantially increase the light transmissivity of the medium in the irradiated region in an imagewise distributed pattern, said element having no layers comprising a thermally activated gas-generating composition. The image comprises residual black metal on the film base, and may be used for overhead transparencies, contact negatives/positives, and the like. A preferred embodiment of the black metal layer comprises a black aluminum layer comprising from at least 19 atomic percent of oxygen to less than 58 atomic percent oxygen.

WIPO PCT publication WO/0069648 discloses a method of imaging an article comprising a metal/metal oxide imageable layer with a laser beam, to impart a color image on the article. The method includes: a) providing an article including a substrate and an imageable layer, the imageable layer comprising a metal/metal oxide layer; b) imagewise applying a laser beam to the article; and c) in the portion of the article having the laser applied thereto, imparting a color to the metal/metal oxide layer different from the color in the non-imaged portion. Preferably, the imageable layer comprises aluminum/aluminum oxide.

EP 684145 discloses a recording element that includes a metal recording layer that is on a roughened substrate, the substrate having an Ra of at least 0.2 $\mu$m and containing a roughening agent at a coverage of between 0.05 and 1.0 g/m$^2$, the roughening agent having an average particle size between 0.3 and 2.0 $\mu$m (page 3, lines 1–9). With regard to the metal layer, the reference explains that possible metals for the recording layers in this invention include Mg, Sc, Y, Ti, Zr, Hf, V, Nb, Ta, Cr, Mo, W, Mn, Re, Fe, Co, Ni, Ru, Rh, Pd, Ir, Pt, Cu, Ag, Au, Zn, Cd, Al, Ga, In, Si, Ge, Sn, As, Sb, Bi, Se, Te. These metals can be used alone or as a mixture or alloy of at least two metals thereof. The reference explains that, due to their low melting point, Mg, Zn, In, Sn, Bi and Te are preferred, with Bi the most preferred. The metal recording layer may be applied on top of the layer containing the roughening agent by vapor deposition, sputtering, ion plating, chemical vapor deposition, electrolytic plating, or electroless plating. In the preferred case of Bi the recording layer is preferably provided by vapor deposition in vacuo (page 4, lines 46–52).

EP 980764 is a later reference by the same applicant as that of the just-discussed EP 684145 reference. The '764 reference discloses a recording element that includes a thin metal layer and a protective layer, characterized in that the element contains hypophosphorous acid, or phosphorous acid, or a mixture of both, with bismuth being the preferred metal layer (page 3, lines 41–51). The '764 references describes previous methods of vacuum deposition of thin bismuth layers as being complicated, cumbersome, and expensive (page 3, lines 14–15).

U.S. Pat. No. 6,066,437 discloses a film which is lettered with a laser beam comprising at least one protective film which is transparent to the laser beam, at least one opaque layer which is ablated by the laser beam, and at least one contrast-forming layer on its bottom. The ablatable layer is preferably a metallic layer and can have a color like the contrast-forming layer. The color of the metallic layer is different from the color of the contrast-forming layer. The contrast-forming layer is either applied, imprinted or varnished onto the metallic layer. The contrast-forming layer can be at least one plastic film. On a side of the contrast-forming layer facing away from the metallic layer there is an adhesive layer which is covered with a carrier material, for example, an adhesive-repellant carrier film (see Abstract). The ablatable layer is preferably a largely metallic layer since this material is preferred for working with a laser beam. With the choice of metal or metal alloy, a certain color can be imparted to the layer. According to one preferred embodiment, the metallic layer is a metal coating which has been vapor-deposited on the protective film, the metallic layer optionally containing at least one hologram. Alternatively or in addition, the metallic layer can also be colored. The metallic layer is preferably an aluminum layer which has been vapor deposited on a protective film. Alternatively to vapor deposition of the metallic layer, it is also possible to apply the metallic layer by sputtering.

WIPO International Publication Number WO 98/45827 discloses a method of recording information in a laminated structure including an intermediate layer located between a transparent layer and a non-absorbing layer. The method includes using a pulsed beam laser to ablate layers of the intermediate layer. The absorbing intermediate layer is preferable a thin metallized layer such as a thin layer of aluminum.

Electroless plating process is a known chemical process of depositing a metal or metal compound from an aqueous solution of a salt of said metal. Its applications can be found in many industries (see, e.g., "Electroless Plating, Fundamentals & Applications", eds. G. O Mallory and J. B. Hajdu, American Electroplaters and Surface Finishers Soc., 1990). It is also widely used to metallize plastics for making the plastics conductive for electroplating or for EMI shielding applications. Deposition of a variety of metals ranging from copper and nickel to silver and gold using this process have been demonstrated. Electroless nickel plating is widely used due to the unique properties of the nickel deposits. Typically, its reaction involves the reduction of nickel ions with a reducing agent in the same solution. For example, the reduction of nickel ions with hypophosphite yields alloys of phosphorus and nickel:

$$Ni^{+2}+2H_2PO_2^-+2H_2O \text{ - - - } Ni^0+2H_2PO_3^-+2H^++H_2$$

$$H_2PO_2^-+H \text{ - - - } OH^-+H_2O+P \text{ (alloy with Ni)}$$

SUMMARY OF THE INVENTION

One aspect of the present invention provides a method of imaging an article. The method of imaging an article comprises the steps of: a) providing an imageable article including: an imageable layer comprising the reaction product of a metal precursor and a reactant, where the reactant includes at least one of phosphorous and boron; a first boundary layer on a first side of the imageable layer, the first boundary layer being substantially transparent to laser radiation; and a second boundary layer on a second side of the imageable layer; b) imagewise applying a laser beam to the article through the first boundary layer; and c) in the portion of the article having the laser applied thereto, thereby decreasing the optical density of the imageable layer while maintaining the continuity of the first boundary layer. Another aspect of the present invention provides an alternative method of imaging an article. This method of imaging an article comprises the steps of: a) providing an imageable article including: an imageable layer comprising the reaction product of a metal ion and a reducing agent; a first boundary layer on a first side of the imageable layer, the first boundary layer being substantially transparent to laser radiation; and a second boundary layer on a second side of the imageable layer; b) imagewise applying a laser beam to the article through the first boundary layer; and c) in the portion of the article having the laser applied thereto, thereby decreasing the optical density of the imageable layer while maintaining the continuity of the first boundary layer.

In preferred embodiments of the above methods, step c) also maintains the continuity of the second boundary layer in the area of the article having the laser applied thereto. In other preferred embodiments of the above methods, step c) also maintains the visible appearance of the first boundary layer. In another aspect of those embodiments, step c) also maintains the visible appearance of the second boundary layer.

In other preferred embodiments of the above methods, step b) includes applying an infrared laser. In yet other preferred embodiments of the above methods, step b) includes applying a continuous wave laser. In other preferred embodiments of the above methods, step b) comprises applying no more than 3 $J/cm^2$. In another aspect of those embodiments, step b) comprises applying no more than 500 $mJ/cm^2$. In yet another aspect of those embodiments, step b) comprises applying no more than 300 $mJ/cm^2$.

In other preferred embodiments of the above methods, step b) comprises applying the laser beam for between 30 nanoseconds and 30 milliseconds to each respective imaged portion. In other preferred embodiments of the above methods, the imaged portion has sufficient contrast relative to the non-imaged portion so as to create a visually perceptible image. In yet other preferred embodiments of the above methods, the imaged portion has sufficient contrast relative to the non-imaged portion so as to create a machine readable image. In another aspect of those embodiments, the machine readable image is in the form of a bar code.

In other preferred embodiments of the above methods, step a) comprises providing the imageable article in roll form. In other preferred embodiments of the above methods, step a) comprises providing the imageable article in sheet form. In yet other preferred embodiments of the above methods, the method further comprises the step of printing an image on the imageable article prior to step b). In other preferred embodiments of the above methods, the method further comprises the step of printing an image on the imageable article subsequent to step c).

Another aspect of the present invention provides a laser imageable article. The laser imageable article comprises: an imageable layer comprising the reaction product of a metal precursor and a reactant, where the reactant includes at least one of phosphorous and boron, a first boundary layer on a first side of the imageable layer, the first boundary layer being substantially transparent to laser radiation, and a second boundary layer on a second side of the imageable layer; where the imageable layer may be imaged with a laser through the first boundary layer while maintaining the continuity of the first boundary layer. Another aspect of the present invention provides an alternative laser imageable article. The laser imageable article comprises: an imageable layer comprising the reaction product of a metal ion and a reducing agent, a first boundary layer on a first side of the imageable layer, the first boundary layer being substantially transparent to laser radiation, and a second boundary layer on a second side of the imageable layer; where the imageable layer may be imaged with a laser through the first boundary layer while maintaining the continuity of the first boundary layer.

In preferred embodiments of the above laser imageable article, the first boundary layer comprises a first polymeric film. In another aspect of those embodiments, the laser imageable article further comprises an adhesive layer between the imageable layer and the first boundary layer. In another aspect of those embodiments, the first boundary layer is in direct contact with the imageable layer. In yet another aspect of those embodiments, the second boundary layer comprises an adhesive layer. In another aspect of those embodiments, the second boundary layer comprises a second polymeric film. In another aspect of those embodiments, the laser imageable article further comprises a layer of adhesive on the second boundary layer opposite the imageable layer.

In other preferred embodiments of the above imageable articles, the first boundary layer comprises an adhesive layer. In another aspect of those embodiments, the second boundary layer comprises a polymeric film. In other preferred embodiments of the above imageable articles, the metal precursor comprises one or more metal precursors selected from columns 8, 9, and 10 of the periodic table of elements. In other preferred embodiments of the above imageable articles, the imageable layer is applied by electroless plating.

In yet other preferred embodiments of the above imageable articles, the imageable layer is applied by vapor deposition or sputtering. In another aspect of those embodiments, the metal precursor comprises nickel. In other preferred embodiments of the above imageable articles, the imageable layer has a thickness of up to 400 nm. In other preferred embodiments of the above imageable articles, the imageable layer comprises from 1 to 30 mole percent phosphorus and up to 99 mole percent nickel. In yet other preferred embodiments of the above imageable articles, the imageable layer comprises from 1 to 40 mole percent boron and up to 99 mole percent nickel. In other preferred embodiments of the above imageable articles, the imageable layer has been chemically modified so as to modify its energy absorbance. In yet other preferred embodiments of the above imageable articles, the imageable article further comprises a printed image.

BRIEF DESCRIPTION OF THE DRAWING

The present invention will be further explained with reference to the appended FIG. 1 which is a cross-sectional view of a preferred embodiment of an imageable article of the present invention.

DETAILED DESCRIPTION OF THE INVENTION

Figure 1:
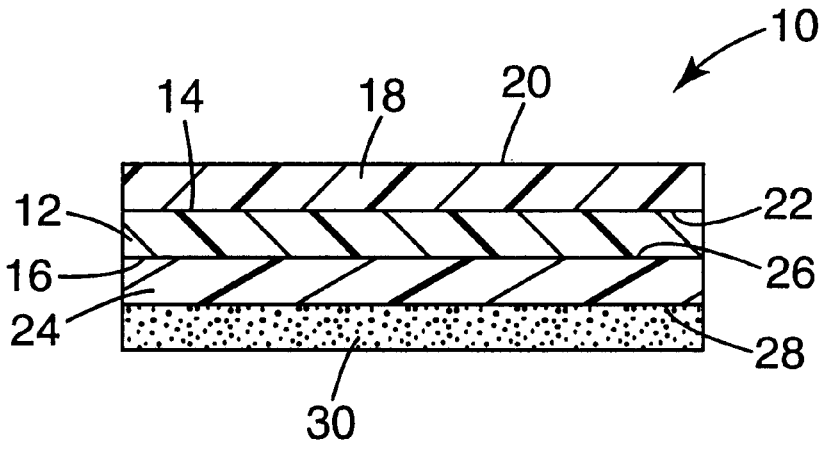

Referring to FIG. 1, there is illustrated there a cross section of a first preferred embodiment of an imageable article 10 according to the present invention. The imageable article 10 includes an imageable layer 12. As will be described in greater detail below, the imageable layer comprises the reaction product of a metal precursor and a reactant. The imageable layer 12 includes a first side 14 and a second side 16. Adjacent the first side 14 of the imageable layer is a first boundary layer 18 which itself includes a first side 20 and a second side 22. In the illustrated embodiment, the second side 22 of the first boundary layer is adjacent the first side 14 of the imageable layer. The first boundary layer is selected so as to allow imaging of the imageable layer 12 by imparting energy through the first boundary layer to the imageable layer. Preferably, the first boundary layer is substantially transparent to laser radiation. It is also preferred that the imageable layer may be imaged with a laser through the first boundary layer while maintaining the continuity of the first boundary layer. Adjacent the second side 16 of the imageable layer 12 is a second boundary layer 24. The second boundary layer includes a first side 26 adjacent the imageable layer and a second side 28 opposite the imageable layer. Also shown in the embodiment of FIG. 1 is an optional layer of adhesive 30.

The imageable layer may be applied by various techniques that result in the reaction product of a metal precursor and a reactant. Suitable techniques include reactive vapor deposition, reactive sputtering, ion plating, chemical vapor deposition, electrolytic plating, or electroless plating. The most preferred technique is electroless plating, in which case the metal precursor comprises a metal ion, and the reactant comprises a reducing agent. Preferably, the metal precursor is selected from columns 8, 9, and 10 of the periodic table of elements, namely Ni, Co, Ag, Au, Cu, Fe, Pt, Sn, and Pb. As to the reactant, it is preferably selected from hypophosphorus acid and salts thereof, including sodium hypophosphite ($NaH_2PO_2$—$H_2O$), sodium borohydride ($NaBH_4$), and dimethylamine borane (DMAB, $(CH_3)_2NHBH_3$).

Preferably, the imageable layer 12 is deposited by an electroless plating process onto the second surface 22 of the first boundary layer 18. The second boundary layer 24 may be then applied to the exposed second surface 16 of the imageable layer. The second boundary layer may be applied by any suitable method, such as by adhering the second boundary layer to the imageable layer with an adhesive (not illustrated) or by casting the second boundary layer onto the imageable layer.

For convenience, the boundary layers are referred to as a first boundary layer and a second boundary layer. Throughout, the terms are selected such that imaging occurs through the first boundary layer 18. However, it is understood that the imageable layer 12 may be electroless plated onto either the first or second boundary layer, with the other boundary layer applied by any suitable means.

In a first preferred embodiment, the imageable layer 12 is deposited onto the first boundary layer 18. In this first embodiment, it is preferable that the first boundary layer comprises a polymeric film. In such embodiment, the first boundary layer is preferably in direct contact with the imageable layer. Preferred films include those that are receptive to having a metallic layer deposited thereon by an electroless plating process, including films comprising ABS, polypropylene, polysulfone, polyetherimide, polyethersulfone, Teflon, polyarylether, polycarbonate, polyphenylene oxide (modified), polyacetal, urea formaldehyde, diallyl phthalate, mineral-reinforced nylon (MRN) and phenolic. Preferred films include clear PET, white PET and Kapton substrates.

In this first preferred embodiment, the second boundary layer 24 may also be any of the films suitable for use as the first boundary layer. Such a film is preferably adhered to the imageable layer with a layer of adhesive (not illustrated) between the second side 16 of the imageable layer and the first side 26. Optionally, an adhesive layer 30 may be applied to the second side 28 of the second boundary layer for mounting the imageable article 10 onto an object. Alternatively, the second boundary layer may itself comprise an adhesive layer.

If present, the adhesive layer may be any desired adhesive which serves to bond the imageable article to a selected adherend. Various types of adhesives are suitable including, but not limited to, thermosetting adhesives such as epoxide resins, urea-formaldehyde resins, phenol-formaldehyde resins, unsaturated polyesters, crosslinked polyurethanes and phenolics; thermoplastic adhesives such as poly(vinyl acetate) and carboxylated styrene-butadiene; hot melt adhesives such as ethylene/vinyl acetate, polyamides and polyesters; and elastomeric adhesives such as acrylics, silicones, poly(isobutylenes), poly(butadienes), poly(alpha-olefins), natural and synthetic rubbers including styrenic block copolymers, and poly(vinyl ethers), all of which may also be formulated to be pressure sensitive adhesives if desired. Other adhesive materials suitable for use include polyurethanes, cyanoacrylates and anaerobic-curing materials. See "Handbook of Adhesives", 3$^{rd}$ Ed., I. Skeist (Ed.), pp. 5–9 and 21–38, Van Nostrand Reinhold, New York, N.Y., 1990.

In a second preferred embodiment, the imageable layer 12 is deposited onto the second boundary layer 24. In this second preferred embodiment, the second boundary layer preferably comprises a film as just described with respect to the first boundary layer 18 of the first preferred embodiment. And with respect to this second preferred embodiment, the first boundary layer 14 preferably comprises any of the preferred constructions described for the second boundary layer of the above-described first preferred embodiment.

As to the imageable layer 12, it is preferably applied by an electroless plating process onto either of the boundary layers, in which case the imageable layer comprises the reaction product of a metal ion with a reducing agent. Preferably, the metal ion comprises an ion of one or more metals selected from columns 8, 9, and 10 of the periodic table of elements, namely Ni, Co, Ag, Au, Cu, Fe, Pt, Sn, and Pb. In the most preferred embodiment, the metal ion comprises nickel ion. As to the reducing agent, it is preferably selected from hypophosphorus acid and salts thereof, including sodium hypophosphite ($NaH_2PO_2$—$H_2O$), sodium borohydride ($NaBH_4$), and dimethylamine borane (DMAB, $(CH_3)_2NHBH_3$). In one particularly preferred embodiment, the imageable layer comprises from 1 to 30 mole percent phosphorus and up to 99 mole percent nickel, more preferably from 10 to 22 mole percent phosphorus and up to 90 mole percent nickel. In another particularly preferred embodiment, the imageable layer comprises from 1 to 40 mole percent boron and up to 99 mole percent nickel more preferably from 3 to 30 mole percent boron and up to 97 mole percent nickel. The imageable layer preferably has a thickness of up to 400 nm, more preferred: 20 to 100 nm.

The imageable layer is preferably applied by an electroless plating process to either the first or second boundary layers. For convenience, the boundary layer to which the imageable layer is applied may be referred to as a "substrate" herein, regardless of whether the imageable layer is applied to the first or second boundary layer. Such a process generally includes sensitizing the substrate, activating the substrate, and then plating the substrate. This may be done in a batch process or continuous process.

In one preferred embodiment, the substrate may be sensitized by immersing it in an aqueous tin (II) chloride solution. One suitable sensitizing solution may be prepared by dissolving 10 grams (g) of 98% $Sn(II)Cl_2$ in a solution of 40 milliLiters (mL) of 37% hydrochloric acid in 160 mL deionized water, and then further diluting the solution with deionized water to a volume of 1.0 Liter (L). The substrate may be dipped in the sensitizing solution for a suitable time, such as 30 to 45 seconds at room temperature, and then rinsed with deionized water for a suitable time, such as about 15 seconds.

The sensitized substrate may be activated by immersing it in a suitable activating solution. One suitable activating solution is an aqueous palladium (II) chloride solution. Such a solution may be made by dissolving 0.2 g of 99.9% $Pd(II)Cl_2$ in a solution of 2.5 mL of 37% hydrochloric acid in 100 mL deionized water, and then further diluting the solution with deionized water to a volume of 1.0 L. The sensitized first boundary layer may be dipped in the activating solution for 30 to 45 seconds at room temperature, followed by rinsing with deionized water for about 15 seconds.

In another preferred embodiment, the substrate may be activated before plating by direct sputtering a thin layer of precious metals such as Pd, Au or Pt with a thickness in the range of 0.1 to 1 nm.

In one preferred embodiment, one side of the activated substrate may be masked off, such as with Scotch brand 1280 plating tape (from 3M Company, St. Paul, Minn.) to prevent deposition of the imageable layer on that surface during the next step.

The activated substrate may then be immersed in desired plating solution containing the desired metal ion and reducing agent. In one preferred embodiment, a suitable plating solution comprises an aqueous nickel (II)/sodium hypophosphite plating solution (such as Nimuden SX, available as 4-component plating solution from Uyemura International Corp., Ontario, Calif.), prepared according to manufacturer's instructions, at about 88° C. for 7 to 60 seconds. This can be followed by rinsing with deionized water, and air drying.

In another preferred embodiment, the plating solution may comprise an aqueous nickel (II)/sodium borohydride plating solution (such as BEL-980, available as 5-component plating solution from Uyemura International Corp., Ontario, Calif.), prepared according to manufacturer's instructions. Such plating may preferably occur by immersion at about 65° C. for 7 to 10 seconds, followed by rinsing with deionized water, and air drying.

In such a manner, a desired imageable layer may be provided on a substrate. That substrate may be the first or second boundary layer. The other respective boundary layer may be applied as described herein.

The imageable article may include printed material on any suitable surface of any desired component. Print may be applied to the exposed surface of the imageable layer before applying the boundary layer thereon. Alternatively, printed material may be applied to the exposed or internal surface of either of the boundary layers. The printed material can be added before or after imaging the imageable layer of the article. Suitable print techniques include flexographic, electrophotographic, silk screen, and lithographic printing. It is also possible to modify the color of the imageable layer itself through chemical means after deposition, prior to application of the second boundary layer. The color modification may be done to enhance contrast after imaging, or to modify the energy absorbing characteristics of the imageable layer. Methods for imparting color by alteration of surface layers of metal-based materials by etching, surface deposition, or oxidation are known in the art. For example, a solution such as Ultra-Blak 465™, sold by Electrochemical Products, Inc., New Berlin, Wis., and based on cobalt ion, may be used to alter the appearance of the imageable layer from gray to black.

The imageable article may be provided in any form as desired, such as in a roll form, or in sheet form, or in any other converted format.

It is desirable to provide a low cost of imaging system, including the imaging hardware and the imageable material. To help keep the overall system cost low, it is preferable that the imaging systems will operate at low power levels for the imaging laser, such as 1.0 to 1.2 W multi-mode laser diodes in the wavelength of 808 nm as the imaging source. In one preferred embodiment, an infra-red laser is used. The laser may be a continuous wave laser. The imageable article of the present invention can be advantageously used as part of such a low-cost, low-power system. Lower power requirements can also allow faster imaging times. Preferably, the imageable article may be imaged by applying no more than 3 $J/cm^2$, more preferably no more than 500 $mJ/cm^2$, and still more preferably no more than 300 $mJ/cm^2$. It is also preferred that the imageable article may be imaged by applying the laser beam for between 30 nanoseconds and 30 milliseconds to each respective imaged portion.

However, this invention is not limited to use with such diode lasers used here. It may be used with any other laser systems at any wavelengths and powers, provided the system can image the inventive imageable articles described herein. Furthermore, the inventive imageable articles of the present invention may be imaged with heating means other than that of laser radiation, such as thermal transfer.

The deliberate visible transformation of the imageable layer is accomplished through heating via a laser of appropriate fluence. At the elevated temperature induced by the interaction of the laser beam with the imageable layer, the optical properties of the imageable layer are transformed in place, while maintaining the continuity of the boundary layers, which means no visible bubble formation or deformations between the two boundary layers occurs to obstruct the clearness of the image. A precise understanding of the exact mechanism producing changes in the optical properties of the layer is not necessary to carry out the present invention. However, it is hypothesized that the mechanism may involve any or a combination of crystallization and melting of the imageable layer, followed by reformation of sub-micron beads. The process occurs in such a way or manner that there is very little heat damage to the boundary layers, maintaining the continuity of the boundary layer. Under other conditions of irradiation, other mechanisms of chemical or physical change may occur, which also result in formation of a visible image.

As deposited, electroless nickel is known to be a metastable, supersaturated alloy of phosphorus or boron with nickel, which is either microcrystalline or amorphous depending on the compositions. It has a lower melting point, lower density and lower thermal conductivity than pure nickel.

Even though electroless plating is a preferred method, the phosphorus or boron compounds or alloys with a metal or a mixture of at least two metals can also easily prepared by other methods such as vapor deposition and sputtering giving the similar microcrystalline or amorphous structures.

A preferred method of imaging an article according to the present invention include: a) providing an imageable article including: an imageable layer comprising the reaction product of a metal precursor and a reactant; a first boundary layer on a first side of the imageable layer, the first boundary layer being substantially transparent to laser radiation; and a second boundary layer on a second side of the imageable layer; b) imagewise applying a laser beam to the article through the first boundary layer; and c) in the portion of the article having the laser applied thereto, thereby decreasing the optical density of the imageable layer while maintaining the continuity of the first boundary layer.

The materials and laser are preferably selected in accordance with the teachings herein such that the imaging method is conducted in such a manner so as to maintain the continuity of the second boundary layer in the area of the article having the laser applied thereto. In other words, the second boundary layer is not removed from the article in the area where the imageable layer is imaged. It is also preferred that the imaging method is carried out in a manner so as to maintain the visible appearance of the first boundary layer. In other words, to an unaided eye in normal room viewing conditions, the imaging method does not appear to change the appearance of the first boundary layer in the area where the imageable layer is imaged. It is also preferred that the method is carried out in such a manner so as to maintain the visible appearance of the second boundary layer. In a preferred embodiment, there is no bubble formation between the first and second boundary layers to obstruct the clearity of the image.

In one preferred embodiment, the method is carried out such that the imaged portion has sufficient contrast relative to the non-imaged portion so as to create a visually perceptible image. Visually perceptible is used herein to mean visually perceptible to the unaided eye. In another preferred embodiment, the imaged portion has sufficient contrast relative to the non-imaged portion so as to create a machine readable image, such as in the form of a bar code, for example.

The present invention allows the image to be formed in a sub-surface fashion embedded in between two barrier layers, such as plastic films, without visible bubbling which may occur with other imageable layers. Sub-surface images provide improved durability, reduced dust formation, and elimination of post-imaging overlamination steps.

The operation of the present invention will be further described with regard to the following detailed examples. These examples are offered to further illustrate the various specific and preferred embodiments and techniques. It should be understood, however, that many variations and modifications may be made while remaining within the scope of the present invention.

EXAMPLE 1

An imageable article 10 having an imageable layer 12 between two boundary layers 18, 24 was prepared as follows. An imageable layer 12 of nickel/phosphorus was applied using an electroless deposition process to a first boundary layer 14, comprising a 0.05 mm (0.002 inches) thick, biaxially oriented, transparent poly(ethylene terephthalate) (i.e., polyester) (PET) substrate. First, the first boundary layer 14 was sensitized by immersing it in an aqueous tin (II) chloride solution. The solution was made by dissolving 10 grams (g) of 98% $Sn(II)Cl_2$ in a solution of 40 milliLiters (mL) of 37% hydrochloric acid in 160 mL deionized water. After the $Sn(II)Cl_2$ was dissolved, the solution was further diluted with deionized water to a volume of 1.0 Liter (L). The first boundary layer film was dipped in the sensitizing solution for 30 to 45 seconds at room temperature and was then rinsed with deionized water for about 15 seconds. Next, the sensitized first boundary layer film was activated by immersing it in an aqueous palladium (II) chloride solution. The solution was made by dissolving 0.2 g of 99.9% $Pd(II)Cl_2$ in a solution of 2.5 mL of 37% hydrochloric acid in 100 mL deionized water. After the $Pd(II)Cl_2$ was dissolved, the solution was further diluted with deionized water to a volume of 1.0 L. The sensitized first boundary layer film was dipped in the activating solution for 30 to 45 seconds at room temperature, followed by rinsing with deionized water for about 15 seconds. The second side 22 of the activated first boundary layer film was masked off using Scotch brand 1280 plating tape (from 3M Company, St. Paul, Minn.) to prevent deposition of phosphorus/nickel on that surface during the next step.

The masked, activated first boundary layer film was then immersed in an aqueous nickel (II)/sodium hypophosphite plating solution (Nimuden SX, available as 4-component plating solution from Uyemura International Corp., Ontario, Calif.), prepared according to manufacturer's instructions, at about 88° C. for 7 to 10 seconds, followed by rinsing with deionized water, and air drying. The process was performed in a manner to obtain the manufacturer's specified deposition rate of 4.2 nm per second. After removal of the masking material, a PET film (first boundary layer) having an imageable opaque, silver/gray layer 12 of nickel/phosphorus with manufacturer's specified phosphorus mole percent from 15 to 20 was obtained.

A second boundary layer 24 comprising a transparent protective film of 0.03 mm (0.001 inches) thick PET having a 0.03 mm (0.001 inches) thick pressure sensitive adhesive layer 30 on one side was applied to the exposed nickel/phosphorus surface using a nip roll laminator at room temperature such that the pressure sensitive adhesive contacted the exposed nickel/phosphorus surface. The adhesive was prepared in accordance with Example 6 of U.S. Pat. No. Re. 24,906, Pressure Sensitive Adhesive Material (Ulrich). The result was an imageable article having a layer of nickel/phosphorus between two boundary layers. Typically, the dimensions of the article were 6 inches×8 inches (15.2 cm×20.3 cm).

This article was imaged through the second boundary layer 24 in the following manner to change the optical density of the imageable layer 12 between the two boundary layers and impart a pattern.

The imageable article 10 was mounted on a modified removable drum which had a diameter of 4 inches (10.2 cm) and a length of 12 inches (30.5 cm), and was part of a Howtek Model 4500 (Edison) drum scanner. The scanner, originally designed for digital image acquisition, was converted to a laser imaging test bed by placing a stationary diode laser and focusing optics adjacent to the photodiode systems used for image acquisition. The imageable article was attached to the rotating drum element of the scanner and imaged using the diode laser which was directed toward the drum. The mounted article was imaged while the drum was rotated along its longitudinal axis and simultaneously moved in a direction parallel to this axis. The laser imaging device employed the timing signals from the image acquisition electronics to coordinate synchronization of the imaging system. The optical beam was modulated in both frequency and amplitude.

A laser beam was applied through the second boundary layer 24 onto the imageable layer 12 using an apparatus having an aluminum heat sink mounting plate, a 1.2 Watt multimode, continuous wave, single diode laser, laser driver circuitry with control software, and collimation and focus optics (available as "Laser Package Focusing Tube with Optics, Model LT230260P-B" from Thor Labs, Newton, N.J.). The diode laser (Model SDL-23-S9850, available from SDL Inc., San Jose, Calif.), which operated at 809 nm, was modified by addition of a 0.4× VPS micro lens (available from Blue Sky, San Jose, Calif.). The laser beam was driven at variable power levels above those required for lasing and was controlled by the printer driver software. The beam was coarsely focused by adjusting the position of the collimation lens and focus lens assembly in order to maximize the visible light emission from the imageable article. The effective beam dimensions, i.e., the dimensions of the focused spot at the surface of the article, were measured microscopically and found to be approximately 8 micrometers×38 micrometers.

Customized laser driver circuitry and control software were used to run the laser diode. Images were created using ADOBE PHOTOSHOP and customized software for generation of bitmap Code 39 barcodes. Images were saved as "*.bmp" type computer files. An image was produced in the imageable layer by powering the laser off and on, through software control, in combination with the horizontal movement of the drum.

Bar code images were produced in the laser treated areas by selective transparentization of the imageable layer and met ANSI Grade B/C standards for legibility and dimensional accuracy. Transparent areas were obtained when the laser was operated at, or above, a threshold power level of 62.5% of the rated input power. This threshold power level corresponded to a calculated laser output power of 298 milliJoules/$cm^2$. There was no visual evidence of outgassing after imaging, e.g., no bubbling between the second boundary layer 24 and nickel/phosphorus imaged layer 12 was observed.

The optical density of the un-imaged portion of the imageable article was measured using a Macbeth Model TD-931 Densitometer (available from GretagMacbeth™ LLC, New Windsor, N.Y.). The electrical conductivity density of the un-imaged portion of the imageable layer was measured using a Model 707B Conductance Monitor (available from Delcom Instruments, Inc., St. Paul, Minn.). Reflectance, transmission, and (by difference) absorbance were determined for the un-imaged portion of the article from the electroless deposited nickel/phosphorus side before applying the second boundary layer and were measured at a wavelength of 810 nanometers using a Lambda 900 spectrophotometer (available from Perkin Elmer Corporation, Norwalk, Conn.). The results are shown in Table 1 below. The optical density of the imaged portion was measured to be below 0.11.

EXAMPLE 2

Example 1 was repeated with the following modification. A white colored PET film, pigmented with barium sulfate, was use as the first boundary layer. The resulting imaged article exhibited white-colored areas where imaged. Optical density and electrical conductivity results are reported in Table 1 below.

EXAMPLE 3

Example 1 was repeated with the following modification. A polyimide film sold under the trade designation KAPTON E film, (available from DuPont, Wilmington, Del.) was used as the first boundary layer. The resulting imaged article exhibited orange-colored areas where imaged. Optical density and electrical conductivity results are reported in Table 1 below.

TABLE 1

| Ex. | Substrate | Optical Density | Conductivity (Mhos) | % Reflect.* | % Transm.* | % Absorb. |
|---|---|---|---|---|---|---|
| 1 | Transparent PET | 1.00 | 0.011 | 35.8 | 11.4 | 52.8 |
| 2 | White PET | 0.72** | 0.001 | N.D. | N.D. | N.D. |
| 3 | KAPTON | 1.21** | 0.005 | N.D. | N.D. | N.D. |

*measured from the deposited nickel/phosphorus side
**excludes substrates
N.D. = not determined

EXAMPLE 4

A first boundary layer (3921 FL Thermal Transfer Acrylate Label Material, available from 3M, St. Paul, Minn.) comprising a 0.05 mm (0.002 inches) thick white pigmented, cast polyurethane-acrylate film, an acrylic pressure sensitive adhesive (PSA) on one side, and a PET cover liner over the adhesive was provided with a layer of nickel/boron using an electroless deposition process as described in Example 1 with the following modifications. The activated film was plated with an aqueous nickel (II)/sodium borohydride plating solution (BEL-980, available as 5-component plating solution from Uyemura International Corp., Ontario, Calif.), prepared according to manufacturer's instructions, by immersion at about 65° C. for 7 to 10 seconds, followed by rinsing with deionized water, and air drying. The pressure sensitive adhesive on the backside of the first boundary layer was protected from the sensitization and activation steps and deposition of nickel/boron by the PET liner present on the labelstock. After replacement of the PET liner with a paper liner, a white, polyurethane-acrylate first boundary layer having an opaque, gray layer of nickel/boron on one face, and pressure sensitive adhesive on the opposite face, was obtained. This material was employed as the first boundary layer in the subsequent Examples 5, 6, 7, and 8.

EXAMPLE 5

A second boundary layer, as described in Example 1 above, was applied to the exposed nickel/boron surface of the article prepared in Example 4 using a nip roll laminator at room temperature such that the pressure sensitive adhesive contacted the exposed nickel/boron surface. The result was an imageable article in the form of a self-adhesive label having a layer of nickel/boron between two boundary layers and a pressure sensitive adhesive on the exposed face of the first boundary layer. Typically, the dimensions of the article were 6 inches×8 inches (15.2 cm×20.3 cm).

This article was imaged through the second boundary layer in the manner described in Example 1 to change the optical density of the imageable layer between the two boundary layers and impart a pattern. The pattern consisted of areas of un-imaged areas of opaque, gray nickel/boron and transparentized areas showing the white background color of the polyurethane-acrylate first boundary layer.

EXAMPLE 6

A second boundary layer comprising a transparent, cast protective film of 0.05 mm (0.002 inches) thick acrylated-polyurethane was provided on one side of a 0.05 mm (0.002 inches) thick pressure sensitive adhesive as follows. A solution of 1 part of 1-hydroxycyclohexylphenyl ketone, a UV photoinitiator, available from Aldrich Chemical Co., Milwaukee, Wis., was dissolved in 100 parts of a mixture consisting of 50 parts of Sartomer 982B88 and 37 parts of Sartomer 966A80 resin (acrylate-terminated aliphatic polyurethane resins, available from Sartomer Company, Exton, Pa.). The solution was warmed to about 70° C. and coated onto a pressure sensitive adhesive transfer film (8141 Optical Adhesive, available from 3M, St. Paul, Minn.) which was supported by a clear PET liner. This was done using a notch bar coater. The coated adhesive transfer film was exposed to UV light from a medium pressure mercury lamp in a laboratory UV curing unit made by Uvexs, Inc., Sunnyvale, Calif. Multiple passes (e.g., three) were made through the unit with exclusion of oxygen to ensure full cure of the acrylated-polyurethane resin.

The resultant clear overlaminate film with PSA on one side was applied (after removal of the clear PET liner) to the exposed nickel/boron surface obtained in Example 4 using a nip roll laminator at room temperature such that the pressure sensitive adhesive contacted the exposed nickel/boron surface. The result was an imageable article in the form of a self-adhesive label having a layer of nickel/boron between two boundary layers and a pressure sensitive adhesive on the exposed face of the first boundary layer. The second boundary layer consisted of an outer surface of clear, cast acrylated-urethane film, and an inner surface of optically clear, pressure sensitive adhesive in contact with the nickel/boron layer. Typically, the dimensions of the article were 6 inches×8 inches (15.2 cm×20.3 cm).

This article was imaged through the second boundary layer in the manner described in Example 1 to change the optical density of the imageable layer between the two boundary layers and impart a pattern. The pattern consisted of areas of un-imaged areas of opaque, gray nickel/boron and transparentized areas showing the white background color of the polyurethane-acrylate first boundary layer.

EXAMPLE 7

Example 6 was repeated with the following modification. The acrylated-polyurethane was cast directly onto the nickel/boron surface of the first boundary layer. The result was a self adhesive label consisting of the nickel/boron imageable layer deposited on a white polyurethane-acrylate labelstock boundary layer and a clear, cured acrylated-polyurethane boundary layer bonded directly to imageable layer.

This article was imaged through the second boundary layer as described in Example 1 to change the optical density of the imageable layer between the two boundary layers and impart a pattern. The pattern consisted of areas of un-imaged areas of opaque, dark gray nickel/boron and transparentized areas showing the white background color of the polyurethane-acrylate first boundary layer.

EXAMPLE 8

A second boundary layer comprising a transparent, cast protective film of 0.05 mm (0.002 inches) thick polyester/epoxy copolymer was prepared as follows. Two parts of a propylene carbonate solution of mixed triaryl sulfonium hexafluoroantimonate salts, a UV photoinitiator for cationic polymerization (available as CD 1010 from Sartomer Company, Exton, Pa.), was dissolved in 100 parts of a mixture of 90 parts of Epalloy 5001 and 10 parts of Voranol 230. Epalloy 5001 (available from CVC Specialty Chemicals, Inc., Maple Shade, N.J.) is a hydrogenated bisphenol A epoxy resin. Voranol 230 (available from Dow Chemical Co., Midland, Mich.) is a low viscosity polyester diol. This solution was coated, at room temperature, directly onto the nickel/boron layer of the article obtained as described in Example 4 using a notch bar coater. The topcoated article was exposed to UV light as described as in Example 6 except oxygen was not excluded. The result was a self adhesive label having the nickel/boron imageable layer deposited on white polyurethane-acrylate first boundary layer and a second boundary layer of clear, cured polyester/epoxy copolymer bonded directly to imageable layer.

This article was imaged through the second boundary layer as described in Example 1 to change the optical density of the imageable layer between the two boundary layers and impart a pattern. The pattern consisted of areas of un-imaged areas of opaque, gray nickel/boron and transparentized areas showing the white background color of the polyurethane-acrylate first boundary layer.

The tests and test results described above are intended solely to be illustrative, rather than predictive, and variations in the testing procedure can be expected to yield different results.

The present invention has now been described with reference to several embodiments thereof. The foregoing detailed description and examples have been given for clarity of understanding only. No unnecessary limitations are to be understood therefrom. All patents and patent applications cited herein are hereby incorporated by reference. It will be apparent to those skilled in the art that many changes can be made in the embodiments described without departing from the scope of the invention. Thus, the scope of the present invention should not be limited to the exact details and structures described herein, but rather by the structures described by the language of the claims, and the equivalents of those structures.

What is claimed is:

1. A method of imaging an article, comprising the steps of:

a) providing an imageable article including: an imageable layer comprising the reaction product of a metal precursor and a reactant, wherein said metal precursor comprises one or more metal precursors selected from columns 8, 9, and 10 of the periodic table of elements, and wherein the reactant includes at least one of phosphorous and boron; a first boundary layer on a first side of the imageable layer, the first boundary layer being substantially transparent to laser radiation; and a second boundary layer on a second side of the imageable layer;

b) imagewise applying a laser beam to the article through the first boundary layer; and c) in the portion of the article having the laser applied thereto, thereby decreasing the optical density of the imageable layer while maintaining the continuity of the first boundary layer.

2. A method or imaging an article, comprising the steps of:

a) providing an imageable article including: an imageable layer comprising the reaction product of a metal ion and a reducing agent, wherein said metal precursor comprises one or more metal precursors selected from columns 8, 9, and 10 of the periodic table of elements; a first boundary layer on a first side of the imageable layer, the first boundary layer being substantially transparent to laser radiation; and a second boundary layer on a second side of the imageable layer;

b) imagewise applying a laser beam to the article through the first boundary layer; and c) in the portion of the article having the laser applied thereto, thereby decreasing the optical density of the imageable layer while maintaining the continuity of the first boundary layer.

3. The method of claim 1 or 2, wherein step c) also maintains the continuity of the second boundary layer in the area of the article having the laser applied thereto.

4. The method of claim 1 or 2, wherein step c) also maintains the visible appearance of the first boundary layer.

5. The method of claim 4, wherein step c) also maintains the visible appearance of the second boundary layer.

6. The method of claim 1 or 2, wherein step b) includes applying an infrared laser.

7. The method of claim 1 or 2, wherein step b) includes applying a continuous wave laser.

8. The method of claim 1 or 2, wherein step b) comprises applying no more than 3 $J/cm^2$.

9. The method of claim 8, wherein step b) comprises applying no more than 500 $mJ/cm^2$.

10. The method of claim 9, wherein step b) comprises applying no more than 300 $mJ/cm^2$.

11. The method of claim 1 or 2, wherein step b) comprises applying the laser beam for between 30 nanoseconds and 30 milliseconds to each respective imaged portion.

12. The method of claim 1 or 2, wherein the imaged portion has sufficient contrast relative to the non-imaged portion so as to create a visually perceptible image.

13. The method of claim 1 or 2, wherein the imaged portion has sufficient contrast relative to the non-imaged portion so as to create a machine readable image.

14. The method of claim 13, wherein the machine readable image is in the form of a bar code.

15. The method of claim 1 or 2, wherein step a) comprises providing the imageable article in roll form.

16. The method of claim 1 or 2, wherein step a) comprises providing the imageable article in sheet form.

17. The method of claim 1 or 2, further comprising the step of printing an image on the imageable article prior to step b).

18. The method of claim 1 or 2, further comprising the step of printing an image on the imageable article subsequent to step c).

19. A laser imageable article, comprising:

an imageable layer comprising the reaction product of a metal precursor and a reactant, wherein said metal precursor comprises one or more metal precursors selected from columns 8, 9, and 10 of the periodic table of elements, and wherein said reactant includes at least one of phosphorous and boron, a first boundary layer on a first side of said imageable layer, said first boundary layer being substantially transparent to laser radiation, and a second boundary layer on a second side of said imageable layer;

wherein said imageable layer may be imaged with a laser through said first boundary layer while maintaining the continuity of said first boundary layer.

20. A laser imageable article, comprising:

an imageable layer comprising the reaction product of a metal ion and a reducing agent, wherein said metal precursor comprises one or more metal precursors selected from columns 8, 9, and 10 of the periodic table of elements, a first boundary layer on a first side of said imageable layer, said first boundary layer being substantially transparent to laser radiation, and a second boundary layer on a second side of said imageable layer;

wherein said imageable layer may be imaged with a laser through said first boundary layer while maintaining the continuity of said first boundary layer.

21. The imageable article of claim 19 or 20, wherein said first boundary layer comprises a first polymeric film.

22. The imageable article of claim 21, further comprising an adhesive layer between said imageable layer and said first boundary layer.

23. The imageable article of claim 21, wherein said first boundary layer is in direct contact with said imageable layer.

24. The imageable article of claim 21, wherein said second boundary layer comprises an adhesive layer.

25. The imageable layer of claim 21, wherein said second boundary layer comprises a second polymeric film.

26. The imageable article of claim 25, further comprising a layer of adhesive on said second boundary layer opposite said imageable layer.

27. The imageable article of claim 19 or 20, wherein said first boundary layer comprises an adhesive layer.

28. The imageable article of claim 27, wherein said second boundary layer comprises a polymeric film.

29. The imageable article of claim 19 or 20, wherein the imageable layer is applied by electroless plating.

30. The imageable article of claim 19 or 20, wherein the imageable layer is applied by vapor deposition or sputtering.

31. The imageable article of claim 19 or 20, wherein said metal precursor comprises nickel.

32. The imageable article of claim 19 or 20, wherein said imageable layer has a thickness of up to 400 nm.

33. The imageable article of claim 19 or 20, wherein said imageable layer comprises from 1 to 30 mole percent phosphorus and up to 99 mole percent nickel.

34. The imageable article of claim 19 or 20, wherein said imageable layer comprises from 1 to 40 mole percent boron and up to 99 mole percent nickel.

35. The imageable article of claim 19 or 20, wherein said imageable layer has been chemically modified so as to modify its energy absorbance.

36. The imageable article of claim 19 or 20, further comprising a printed image.

* * * * *

UNITED STATES PATENT AND TRADEMARK OFFICE

CERTIFICATE OF CORRECTION

PATENT NO. : 6,692,895 B2
APPLICATION NO. : 09/864638
DATED : February 17, 2004
INVENTOR(S) : Huang, Haitao It is certified that error appears in the above-identified patent and that said Letters Patent is hereby corrected as shown below:

Column 14
Line 58, delete "or" and insert in place thereof - - of - -.

Signed and Sealed this

Twenty-ninth Day of August, 2006

JON W. DUDAS
*Director of the United States Patent and Trademark Office*